US010224591B2

(12) United States Patent
Petrovic

(10) Patent No.: US 10,224,591 B2
(45) Date of Patent: Mar. 5, 2019

(54) FLAT RADIO FREQUENCY TRANSMISSION LINE

(71) Applicant: ViaSat, Inc., Carlsbad, CA (US)

(72) Inventor: Branislav A Petrovic, Falls Church, VA (US)

(73) Assignee: ViaSat, Inc., Carlsbad, CA (US)

( * ) Notice: Subject to any disclaimer, the term of this patent is extended or adjusted under 35 U.S.C. 154(b) by 29 days.

(21) Appl. No.: 15/704,942

(22) Filed: Sep. 14, 2017

(65) Prior Publication Data

US 2018/0083334 A1 Mar. 22, 2018

Related U.S. Application Data

(60) Provisional application No. 62/395,907, filed on Sep. 16, 2016.

(51) Int. Cl.

| | |
|---|---|
| ***H01P 1/30*** | (2006.01) |
| ***H01P 3/06*** | (2006.01) |
| ***H01P 3/08*** | (2006.01) |
| ***H01P 5/08*** | (2006.01) |
| ***H01P 11/00*** | (2006.01) |
| ***H01R 24/42*** | (2011.01) |
| ***H01R 13/623*** | (2006.01) |

(52) U.S. Cl.

CPC ..... *H01P 5/085* (2013.01); *H01P 1/30* (2013.01); *H01P 3/06* (2013.01); *H01P 3/08* (2013.01); *H01P 3/085* (2013.01); *H01P 11/003* (2013.01); *H01R 24/42* (2013.01); *H01R 13/623* (2013.01)

(58) Field of Classification Search

CPC .... H01P 5/085; H01P 1/30; H01P 3/06; H01P 3/08; H01P 3/085; H01P 11/003; H01R 24/42; H01R 24/13623; H01B 7/08

USPC ..... 333/12

See application file for complete search history.

(56) References Cited

U.S. PATENT DOCUMENTS

| | | | | |
|---|---|---|---|---|
| 3,510,805 A * | 5/1970 | Sterzer | ..... | H01L 47/00 327/570 |
| 5,525,953 A | 6/1996 | Okada et al. | | |
| 6,055,722 A | 5/2000 | Tighe et al. | | |
| 6,900,390 B2 | 5/2005 | Halter | | |

(Continued)

FOREIGN PATENT DOCUMENTS

| | | |
|---|---|---|
| CN | 204084554 | 1/2015 |
| JP | H09298408 | 11/1997 |

OTHER PUBLICATIONS

Jon Varteresian, Fabricating Printed Circuit Boards, Chapter 3 (Placement and Routing Considerations for Various Circuit Designs), 2002, pp. 47-56, Elsevier Science (USA), Woburn, MA.

(Continued)

*Primary Examiner* — Robert J Pascal
*Assistant Examiner* — Kimberly E Glenn
(74) *Attorney, Agent, or Firm* — Chang & Hale LLP

(57) ABSTRACT

A radio frequency (RF) transmission line includes a first conductive layer, a second conductive layer conductively isolated from the first conductive layer, a center conductor disposed between the first conductive layer and the second conductive layer, dielectric material disposed between the first conducive layer and the second conductive layer and at least partially surrounding the center conductor, and an RF choke element that conducts a direct current signal between the center conductor and the second conductive layer.

33 Claims, 11 Drawing Sheets

(56) References Cited

U.S. PATENT DOCUMENTS

| | | | | |
|---|---|---|---|---|
| 7,446,633 | B2 | 11/2008 | Yagisawa | |
| 7,479,602 | B2 | 1/2009 | Ju | |
| 7,911,400 | B2 | 3/2011 | Kaplan et al. | |
| 8,308,505 | B2 | 11/2012 | Hatton et al. | |
| 8,587,953 | B2 | 11/2013 | Brock et al. | |
| 8,692,116 | B2 | 4/2014 | Holland | |
| 8,772,640 | B2 | 7/2014 | Hatton et al. | |
| 9,053,837 | B2 | 6/2015 | Holland | |
| 9,087,840 | B2 | 7/2015 | Lin et al. | |
| 9,431,151 | B2 | 8/2016 | Hatton et al. | |
| 2008/0110020 | A1 | 5/2008 | Heisen | |
| 2015/0340204 | A1* | 11/2015 | Kudela | H01J 37/32577 315/39 |
| 2016/0329130 | A1 | 11/2016 | Evans et al. | |
| 2016/0372237 | A1 | 12/2016 | Hatton et al. | |
| 2017/0047986 | A1 | 2/2017 | Petrovic et al. | |

OTHER PUBLICATIONS

Iulian Rosu, YO3DAC/VA3IUL, Microstrip, Stripline, and CPW Design, http://www.qsl.net/va3iul/Microstrip_Stripline_CPW_Design/Microstrip_Stripline_and_CPW_Design.pdf.

* cited by examiner

FLAT RADIO FREQUENCY TRANSMISSION LINE

CROSS-REFERENCE TO RELATED APPLICATION(S)

This application claims priority to U.S. Provisional Application No. 62/395,907, filed Sep. 16, 2016, and entitled VERY THIN FLAT RF CABLE, the disclosure of which is hereby incorporated by reference in its entirety.

BACKGROUND

The present disclosure relates to communications systems, and more particularly to data and power transmission cables and structures.

Radio frequency (RF) transmission lines can include a plurality of conductors for communicating RF signals. The design, configuration, and connections associated with such conductors can affect current-carrying capability and/or physical dimensions thereof.

SUMMARY

In some implementations, the present disclosure relates to a radio frequency (RF) transmission line comprising a first conductive layer, a second conductive layer conductively isolated from the first conductive layer, a center conductor disposed between the first conductive layer and the second conductive layer, dielectric material disposed between the first conducive layer and the second conductive layer and at least partially surrounding the center conductor, and an RF choke element that conducts a direct current signal between the center conductor and the second conductive layer. The RF choke element may comprise an inductor having a first end conductively coupled with the second conductive layer and a second end conductively coupled to the center conductor. The RF transmission line may have a characteristic impedance defined by the first conductive layer, the second conductive layer, the center conductor and the dielectric material. In certain embodiments, the RF transmission line is a transverse-electromagnetic mode (TEM) line.

The RF transmission line may further comprise a connector structure at a first distal end of the RF transmission line, wherein the connector structure comprises a ground reference structure that is conductively coupled to the first conductive layer, the second conductive layer is conductively coupled to the center conductor, and the connector structure is a coaxial connector that comprises a center pin that is conductively coupled to the center conductor and the RF choke element at a node. In certain embodiments, the first conductive layer lies in a first plane, the second conductive layer lies in a second plane that is parallel to the first plane, and the center conductor lies at least partially in a third plane that is parallel to, and positioned vertically between, the first plane and the second plane. In certain embodiments, the node lies in the second plane, and the center conductor is conductively coupled to the node by a via that passes at least partially through the dielectric material.

In certain embodiments, the RF choke element comprises an inductor, the inductor is disposed at least partially above a top surface of the RF transmission line, and the second conductive layer has an opening therein at least partially below the inductor. For example, the center conductor may be routed around the opening such that the opening does not vertically overlap the center conductor. The RF transmission line may further comprise a blocking capacitor coupled between the center conductor and one end of the RF choke element. Furthermore, a cross-section of the RF transmission line at a midpoint along a longitudinal dimension of the RF transmission line has a thickness in a vertical dimension of the RF transmission line that is less than 3 mm.

The first conductive layer may be separated from the second conductive layer by a constant distance along a length of the center conductor. In certain embodiments, the RF transmission line further comprises an RF shielding structure that at least partially covers the RF choke element. For example, the RF shielding structure may comprise a conductive lip configured to capacitively couple to one of the first conductive layer and the second conductive layer. The RF shielding structure may further comprises a second conductive lip configured to capacitively couple to another of the first conductive layer and the second conductive layer. In certain embodiments, the second conductive layer has a first resistance, and the center conductor has a second resistance greater than the first resistance. The second conductive layer may have a first current capacity, and the center conductor may have a second current capacity that is less than the first current capacity.

In some implementations, the present disclosure relates to a data communication system comprising an indoor signal processing unit comprising a first coaxial cable including a first central conductor and a first ground structure, the indoor signal processing unit configured to communicate a multiplexed signal comprising an RF component and a direct current (DC) component via the first coaxial cable, an outdoor signal processing unit comprising a second coaxial cable including a second central conductor and a second ground structure, the outdoor signal processing unit configured to communicate the multiplexed signal via the second coaxial cable, and a flat transmission line connected at a first end to the first coaxial cable and at a second end to the second coaxial cable. The flat transmission line comprises a first conductive layer conductively coupled to the first ground structure and the second ground structure, a second conductive layer physically isolated from the first conductive layer, a center conductor disposed between the first conductive layer and the second conductive layer, the center conductor being coupled to the first central conductor and the second central conductor to carry the RF component, a first radio frequency (RF) choke element conductively coupled to a first end of the center conductor and to a first end of the second conductive layer, and a second RF choke element conductively coupled to a second end of the center conductor and to a second end of the second conductive layer, wherein the first and second RF choke elements are configured to conduct at least a portion of the DC component of the multiplexed signal between the center conductor and the second conductive layer.

In certain embodiments, the flat transmission line is configured to be installed between a window pane and a frame of a window installment. The outdoor signal processing unit may be coupled to an antenna configured to wirelessly communicate the RF component of the multiplexed signal. The center conductor may be coupled to the first central conductor and the second central conductor to carry a portion of the DC component.

In some implementations, the present disclosure relates to a method of manufacturing a radio frequency (RF) cable. The method comprises disposing first and second conductive layers on a substrate, the substrate conductively isolating the first conductive layer from the second conductive layer, forming a center conductor between the first conductive layer and the second conductive layer in the substrate, and conductively coupling an RF choke element between the center conductor and the second conductive layer, the RF choke element being configured to conduct a direct current signal between the center conductor and the second conductive layer. The RF choke element may comprise an inductor connected in series with the second conductive layer.

The method may further comprise conductively coupling a signal transmission pin of a coaxial cable connector to the center conductor and the RF choke element at a node. The method may further comprise forming a conductive via connecting the center conductor to the node. In certain embodiments, the RF choke element comprises an inductor. For example, the method may further comprise forming a first window in the first conductive layer at least partially below the inductor and forming a second window in the second conductive layer at least partially below the inductor. In certain embodiments, disposing the center conductor comprises routing the center conductor such that the first window and the second window do not vertically overlap the center conductor. The method may further comprise covering the RF choke element with an RF shielding structure. The method may further comprise disposing a lip of the RF shielding structure above the second conductive layer to capacitively couple the lip form to the second conductive layer.

In some implementations, the present disclosure relates to a method of communicating data. The method comprises providing a signal having a direct current (DC) component and a radio-frequency (RF) component to a node of a flat RF cable, the node being conductively coupled to a first conductive layer of the flat RF cable and a center conductor of the flat RF cable, blocking the RF component from propagating on the first conductive layer using an inductor connected in series with the first conductive layer, communicating a first portion of the DC component through the inductor and on the first conductive layer, communicating a second portion of the DC component on the center conductor, and communicating the RF component on the center conductor, wherein a second conductive layer of the flat RF cable provides an RF ground, and the first conductive layer provides a virtual RF ground, for said communicating the RF component on the center conductor. The second conductive layer may be configured to capacitively couple to the first conductive layer to provide the virtual RF ground. The method may further comprise coupling a connector of the flat RF cable to a coaxial cable. In certain embodiments, providing the signal to the node comprises communicating the signal on a central pin of the coaxial cable, the central pin being conductively coupled to the node.

BRIEF DESCRIPTION OF THE DRAWINGS

Various embodiments are depicted in the accompanying drawings for illustrative purposes, and should in no way be interpreted as limiting the scope of this disclosure. In addition, various features of different disclosed embodiments can be combined to form additional embodiments, which are part of this disclosure.

DETAILED DESCRIPTION

The headings provided herein are for convenience only and do not necessarily affect the scope or meaning of the claimed invention.

Figure 1:
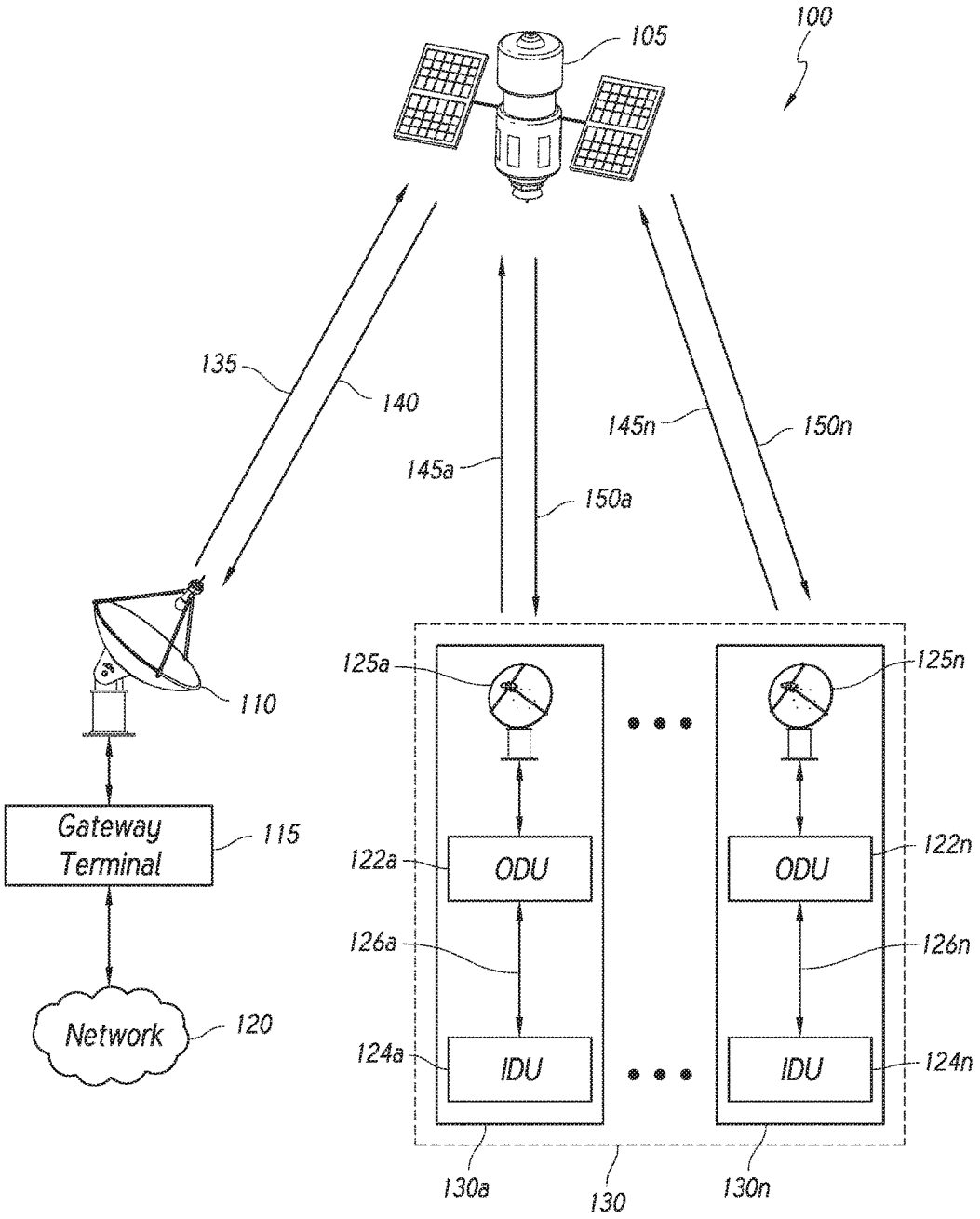
FIG. 1 is a diagram of a satellite communication system in accordance with one or more embodiments of the present disclosure.

In certain implementations, the present disclosure relates to systems, devices and methods for communicating radio frequency (RF) and direct current (DC) signals. For example, certain embodiments of disclosed herein may be implemented in a satellite communication system. FIG. 1 is a diagram of a satellite communication system 100 in accordance with various aspects of the present disclosure. The satellite communication system 100 includes a satellite 105 linking a gateway terminal 115 with one or more satellite user terminals 130. The satellite communication system 100 may utilize various network architectures consisting of space and ground segments. For example, the space segment may include one or more satellites, while the ground segment may include one or more satellite user terminals, gateway terminals, network operations centers (NOCs), satellite and gateway terminal command centers, and/or the like. Some of these elements are not shown in the figure for clarity.

The gateway terminal 115 may be referred to as a hub or ground station. In certain embodiments, the gateway terminal 115 is configured or designed to service forward uplink signals 135 to a satellite 105, and return downlink signals 140 from the satellite 105. The gateway terminal 115 may also schedule traffic to and/or from the user terminal(s) 130. Alternatively, the scheduling may be performed in other parts of the satellite communication system 100 (e.g., at one or more NOCs and/or gateway command centers, neither of which are shown in this example).

The gateway terminal 115 may also provide an interface between a network 120 (e.g., the Internet) and the satellite 105. The gateway terminal 115 may receive data and information from the network 120 that is directed to the satellite user terminals 130. The gateway terminal 115 may format the data and information for delivery to the satellite user terminals 130 via the satellite 105. The gateway terminal 115 may also receive signals carrying data and information from the satellite 105. This data and information may be from the satellite user terminals 130 and directed to destinations accessible via the network 120. The gateway terminal 115 may format this data and information for delivery via the network 120.

The network 120 may be any type of network and may include, for example, the Internet, an IP network, an intranet, a wide-area network (WAN), a local-area network (LAN), a virtual private network (VPN), a public switched telephone network (PSTN), a public land mobile network, and/or the like. The network 120 may include both wired and wireless connections as well as optical links. The network 120 may connect the gateway terminal 115 with other gateway terminals that may be in communication with the satellite 105 or with other satellites.

The gateway terminal 115 may use one or more antennas 110 to transmit the forward uplink signals 135 to the satellite 105 and to receive the return downlink signals 140 from the satellite 105. In certain embodiments, the antenna 110 includes a reflector with relatively high directivity in the direction of the satellite 105 and/or low directivity in other directions. The antenna 110 may be implemented in a variety of alternative configurations and include operating features such as high isolation between orthogonal polarizations, high efficiency in the operational frequency bands, low noise, and the like.

The satellite 105 may be a geostationary satellite that is configured to receive and transmit signals. The satellite 105 may receive the forward uplink signals 135 from the gateway terminal 115 and transmit one or more corresponding forward downlink signals 150 to one or more satellite user terminals 130. The satellite 105 may also receive one or more return uplink signals 145 from one or more satellite user terminals 130 and transmit corresponding return downlink signals 140 to the gateway terminal 115.

The forward downlink signals 150 may be transmitted from the satellite 105 to one or more of the user terminals 130. The user terminals 130 may receive the forward downlink signals 150 using antennas 125. In certain embodiments, an antenna and a user terminal together include a very small aperture terminal (VSAT) with the antenna, for example, measuring approximately 0.75 meters in diameter and/or operating at approximately 2 watts of power. In other examples, a variety of other types of antennas 125 may be used to receive the forward downlink signals 150 from the satellite 105. Each of the satellite user terminals 130 may include a single user terminal or a hub or router coupled to other user terminals. Each of the user terminals 130 may be connected to various consumer premises equipment (CPE) such as computers, local area networks, internet appliances, wireless networks, and the like.

The satellite user terminals 130 may transmit data and information to a destination accessible via the network 120. The user terminals 130 may transmit the return uplink signals 145 to the satellite 105 using the antennas 125. The user terminals 130 may transmit the signals according to a variety of physical layer transmission techniques including a variety of multiplexing schemes and/or modulation and coding schemes. For example, the satellite user terminals 130 may use high speed signal switching for the return uplink signals 145. The switching patterns may support both MBA and APAA systems. When the user terminals 130 use high speed signal switching for the return uplink signals 145, each transmitted signal may be an example of a pulsed radio frequency (RF) communication from the satellite user terminal 130. The satellite user terminals 130 may operate at RF bands such as Ka band frequencies. The amount of frequency resources and fraction of time a satellite user terminal 130 transmits may determine the capacity of the satellite user terminal 130.

The satellite user terminals 130 may include an outdoor unit 122 (ODU) and an indoor unit (IDU) 124. The outdoor unit 122 and the indoor unit 124 may be coupled to each other using a communication link 126, which may comprise one or more cables, such as coaxial cables. The outdoor unit 122 may comprise radio frequency circuitry to wirelessly communicate with the satellite 105 using the uplink 145 and downlink 150 through the antenna 125. The indoor unit 124 may have a wired or wireless router connected to the user's computer or computer network (not shown) for communicating information back and forth with the user. In certain embodiments, the indoor unit 124 facilitates the communication between the user and the outdoor unit 122 over the communication link 126 so that the outdoor unit 124 can communicate with the gateway terminal 115 through the satellite 105.

In certain embodiments, the outdoor unit 122 and the indoor unit 124 may be placed in separate physical locations. For example, the outdoor unit 122 may be placed outside the end user's premise for facilitating improved wireless connectivity with the satellite 105 using the antenna 125 coupled to the outdoor unit 122. On the other hand, as the name implies, the indoor unit 124 may be placed inside the end user's premise (e.g., home, office, etc.). The indoor unit 124 may have a wired or wireless router for connecting to a computer or a network of computers.

The communication link 126 may comprise a physical transmission cable assembly, which may be used to provide data and/or power connectivity between the indoor unit 124 and the outdoor unit. For example, the transmission cable assembly may comprise one or more coaxial cables or cable segments, which may advantageously provide desirable signal integrity for RF signals due to the containment of electromagnetic fields within the cable, as described in greater detail below. In certain embodiments, the communication link 126 comprises a flat cable configured to interface with one or more coaxial cables. In some implementations, as described in detail below, the communication link 126 comprises a flat cable having a relatively thin profile, and configured to be installed as to traverse a window, wall, or other structural feature/installation that is physically disposed between the indoor unit 124 and the outdoor unit 122.

Figure 2:
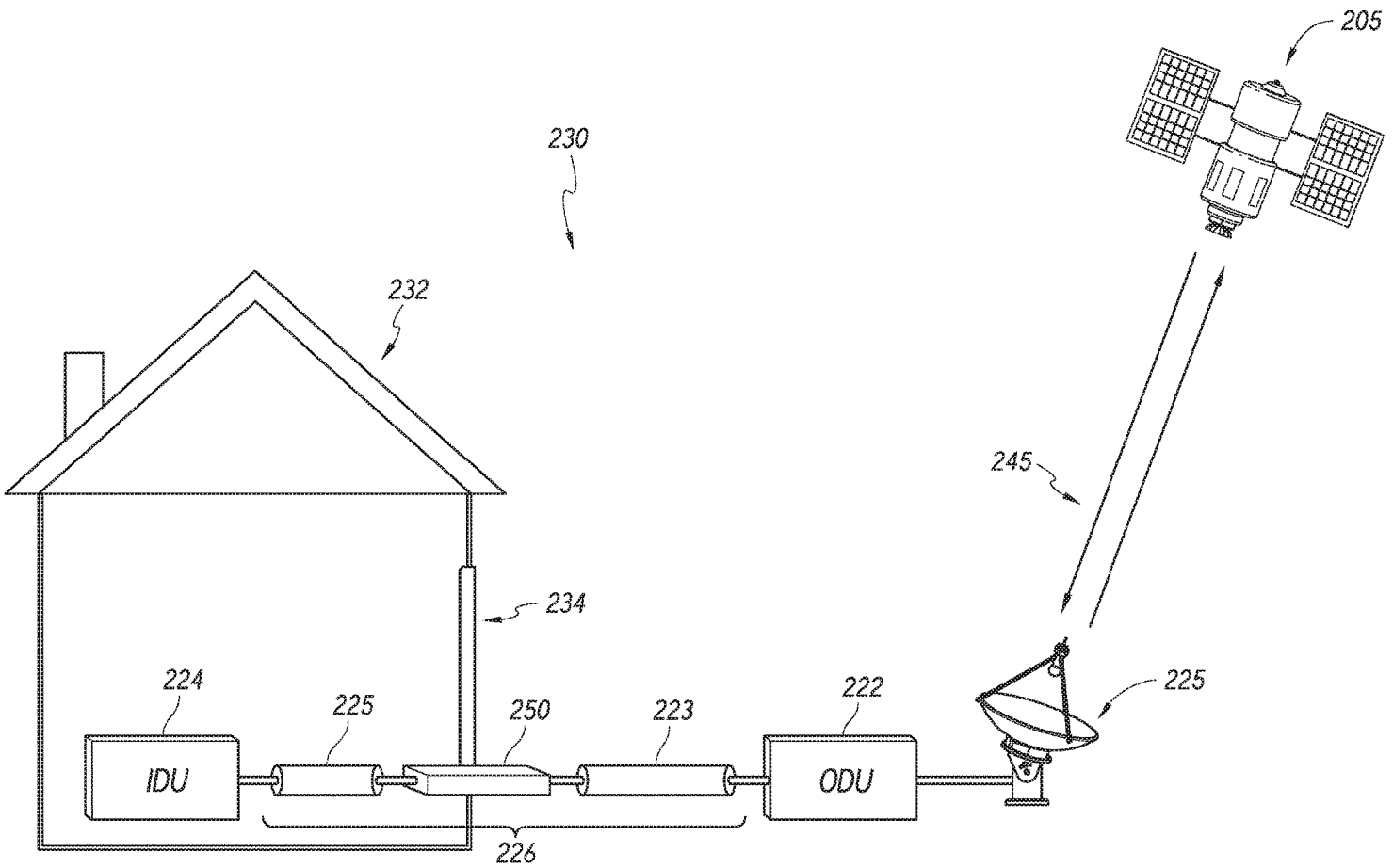
FIG. 2 is a diagram of a user terminal system comprising according to one or more embodiments.

FIG. 2 illustrates a user terminal system 230 according to one or more embodiments. Similarly to the user terminal(s) 130 shown in FIG. 1, the user terminal system 230 includes an indoor signal processing unit 224 and an outdoor signal processing unit 222 coupled by a communication link 226. The user terminal system 230 may represent one non-limiting implementation of the user terminals 130 shown in FIG. 1. In particular, the outdoor signal processing unit (ODU) 222, the communication link 226, and the indoor signal processing unit (IDU) 224 of FIG. 2 illustrate a particular non-limiting illustration of the outdoor unit (ODU) 122, communication link 126 and the indoor unit (IDU) 124 of FIG. 1, respectively.

The outdoor signal processing unit 222 may include one or more RF communication units, modems (e.g., satellite modem), baseband signaling modules, and/or other processing modules, memory buffers, powering circuitry, or other signal processing components, which are omitted from the diagram of FIG. 2 for convenience. The outdoor signal processing unit 222 may be configured to implement certain signal processing functionality, such as encoding/modulation, demodulation/decoding, error correction, control functions, data buffering, digital-to-analog (DAC) and/or analog-to-digital (ADC) conversion, up/down conversion, power amplifier (PA) and/or low noise amplifier (LNA) functionality, and/or signal conditioning/filtering. In certain embodiments, the outdoor signal processing unit 222 is configured to wirelessly communicate with a satellite 205 via an antenna 225.

The indoor signal processing unit 224 may comprise, among possibly other component(s), a network router device or module (not shown). The indoor signal processing unit 224 may be configured to communicate with various personal communication devices or user devices, such as mobile devices, laptops, gaming counsels and devices, appliances, workstations, computer servers, or any other computing device. The terminal system 230 may allow for such device(s) to connected to a gateway terminal through the satellite 205. The coupling between the indoor signal processing unit 224 and a computer device or system may be either wired (e.g., Ethernet) or wireless (e.g., Wi-Fi). In some implementations, the indoor signal processing unit 224 includes certain satellite modem and/or baseband signaling functionality.

The communication link 226 may be utilized for data communications between the indoor signal processing unit 224 and the outdoor signal processing unit 222, and may further be used to provide power to the outdoor signal processing unit 222. The communications between the indoor signal processing unit 224 and the outdoor signal processing unit 222 over the communication link 226 may comprise radio frequency (RF) signals, baseband signals, and/or direct current (DC) signals. In situations in which the indoor signal processing unit 224 resides within a structure 232 (e.g., residential or commercial building), some user terminal systems are implemented by drilling or otherwise forming a hole in a wall of the structure 232, and running a cable of the communication link 226 through the hole in order to connect the indoor signal processing unit 224 to the outdoor signal processing unit 222. However, physical damage associated with drilling holes and/or the like may be undesirable in certain environments or embodiments. As an alternative, in some implementations, a flat radio frequency cable 250 may be routed underneath the door or window 234 of the structure 232. However, certain flat radio frequency cables may be too thick (e.g., 0.12 inches, or more) to fit under a window or door, particularly with respect to energy-efficient windows or doors providing only relatively tight gaps thereunder.

Figure 3:
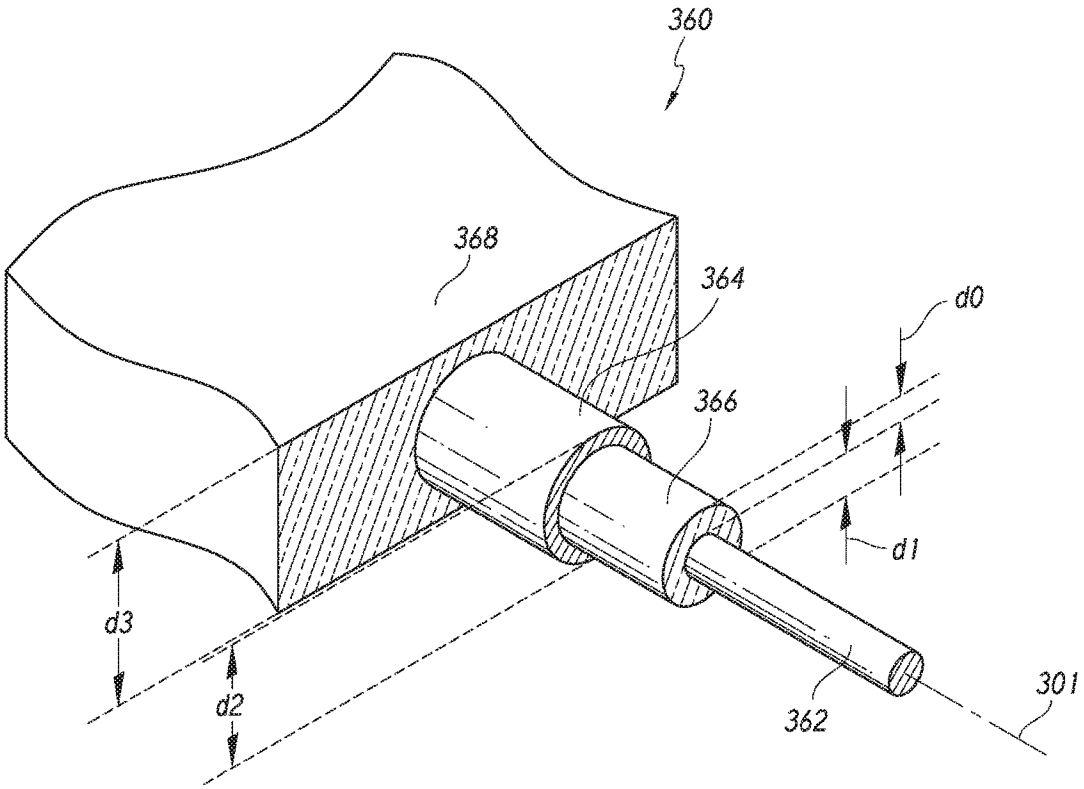
FIG. 3 (Prior Art)
FIG. 3 illustrates a cut-away perspective view of an example prior art coaxial cable.

The thickness of some flat radio frequency cables may be due at least in part to the inclusion therein of shielded coaxial cable transmission lines, which may be accompanied by reinforcing jackets and/or tracking wires to protect the cable from undesirably sharp bending and/or pinching. For example, FIG. 3 illustrates a cut-away perspective view of an example prior art coaxial cable 360. The illustrated coaxial cable 360 includes an inner conductor 362 surrounded by a tubular insulating layer 366, which is surrounded by a tubular conducting shield 364. The shield 364 may comprise, for example, braided aluminum foil, or other conductive material. The cable 360 further includes an insulating outer sheath or jacket 368. The inner conductor 362 and the outer shield 364 share a central axis 301. The cable 360 further comprise one or more tracking wires (not shown) that provide mechanical strength.

With respect to indoor-to-outdoor signal processing unit communication links, coaxial cables associated therewith may generally be configured to transmit power in addition to data on inner/center conductors thereof. Therefore, a cable designed to interface with such cables may need to be to configured to receive RF signals and DC power on a single input and/or output conductor thereof. The dimensions of the cable 360 may be designed to provide an insulator thickness d0, which may enable the cable 360 to function efficiently as a transmission line. The inner conductor 362 may have a generally-circular cross-section, having a diameter d1 that is adequate to provide the desired current-carrying and/or data signal communication capability. Furthermore, the outer shield 364 may have a diameter d2 and thickness that provides desirable shielding effects for the cable 360. The thickness dimension d3 of the cable may be dictated at least in part by the thicknesses of the inner conductor 362, insulator 366, and outer shield 364, and may further be designed to provide desirable physical strength and/or rigidity for the cable 360. Therefore, RF cables configured to carry power may necessarily have a minimum wire size that is required for the relevant power-carrying capability, which may place a lower limit on the coaxial cable diameter d2. Where the inner conductor 362 is too thin, a current of 2 A or more may result in a substantial increase in temperature due to the electrical resistance of the conductor, which may be unacceptable or result in thermal runaway and/or cause melting, fire, and/or shock hazards. Therefore, the center conductor 362 may have a thickness d1 of 0.3 mm or more in some implementations. The thickness of the coaxial cable d2 may be 2 mm or more, and may result in a thickness d3 of the cable 360 that is 3 mm, or more, depending on the design, which may not be sufficiently thin for some under-window/door installations.

As an alternative to coaxial cables, non-coaxial, non-shielded ribbon cables (e.g., twin-strip cables) may be implemented in some systems to provide relatively thin data communication links. However, such cables may be primarily suitable for relatively low-frequency applications, such as audio frequency communications. For example, due to their non-shielding construction, parallel conductors of such cables may undesirably act as antennas and be generally unusable at radio frequencies, where the electromagnetic interference ingress and egress may degrade performance and/or potentially violate electromagnetic compatibility (EMC) compliance regulations.

Certain embodiments disclosed herein advantageously provide relatively thin, non-coaxial-based radio frequency (RF) cables configured to provide sufficient electromagnetic interference immunity, as well as capability of carrying RF signals without receiving and/or transmitting substantial interference. Furthermore, embodiments of thin RF cables disclosed herein advantageously provide multi-amp power-carrying capacity, and may be suitable for implementation in user terminal systems for communication of data and power between indoor and outdoor signal processing units. Such cables, as described herein, may be configured and designed to be installed between a window/door and its respective frame, as described above in reference to FIG. 2, and to provide data and power transmission capability. Thin, flat radio frequency cables in accordance with the present disclosure may be configured to receive a combined RF/DC signal, wherein DC power from the signal is diplexed and injected, via an inductor, into a top layer of the cable that is disconnected electrically from ground, which may enable relatively high-current capability. In certain embodiments, the cable may advantageously have a thickness of approximately 0.5 mm, or less. Embodiments of the present disclosure may provide for simplified installation of indoor-to-outdoor communication link cables, and may eliminate the need to drill through or otherwise damage walls or other structures in order to provide through-wall data and power communication.

Figure 4A:
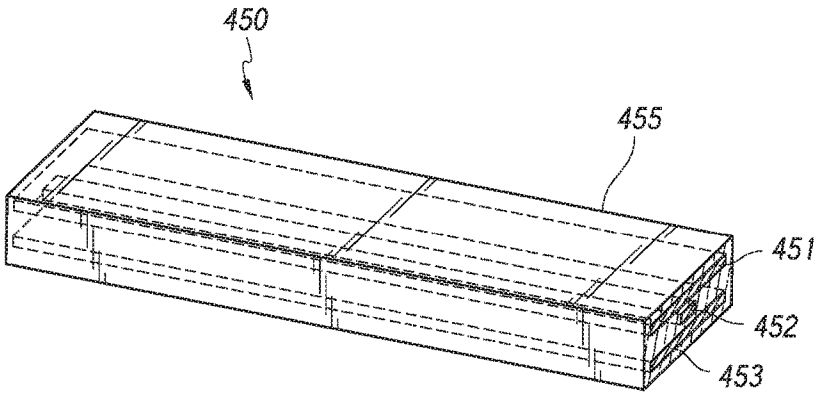
FIGS. 4A-4C provide perspective, side, and cross-sectional views of a stripline in accordance with one or more embodiments.
Figure 4B:
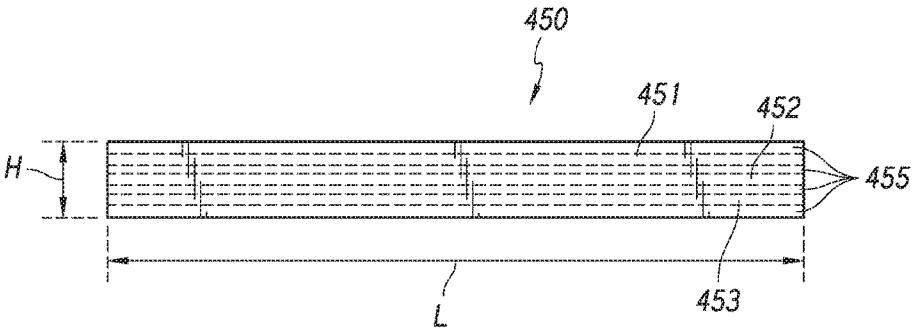
Figure 4C:
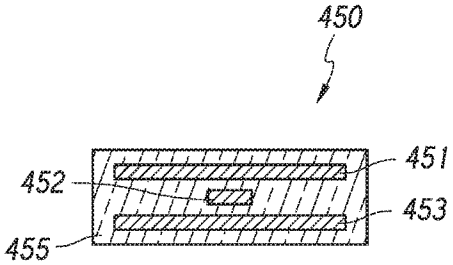

In some implementations, the present disclosure provides a flat RF cable having a stripline-based design. FIGS. 4A-C provide perspective, side, and cross-sectional views of a stripline 450 in accordance with one or more embodiments. The stripline 450 may be at least partially flexible. The stripline 450 may comprise a plurality of metal conductors, or layers. The term "layer" is used herein according to its broad and ordinary meaning, and may refer to any deposition of material, such as electrical conductor or signal line, over a surface or area, such as a substrate surface or area. The term "layer" may further be used herein in connection with one or more of the accompanying figures to describe, with reference to a data and/or power communication cable or transmission line, a substantially homogeneous material disposed at least partially in a plane having a generally horizontal or vertical orientation with respect to an illustrated perspective of the cable or transmission line. For example, such layer(s) may comprise a conductor and/or insulator that runs along a length of the cable or transmission line. Furthermore, such layer(s) may have a relative vertical offset with respect to a generally upright illustrated orientation of the cable(s)/transmission line(s), such as in, for example, FIGS. 4B and 4C. Although certain "layers" are described herein as at least partially flat and/or rectangular in shape, it should be understood that such features may be at least partially circular/cylindrical, or otherwise-shaped. Furthermore, in some contexts, "layer" may refer to a path, channel, or line patterned from a broader layer. Although certain spatially relative terms, such as "outer," "inner," "upper," "lower," "below," "above," "vertical," "horizontal," "top," "bottom," and similar terms, are used herein to describe a spatial relationship of one element/component (e.g., layer) to another, it is understood that these terms are used herein for ease of description to describe the relations between element(s)/component(s), as illustrated in the drawings. It should be understood that the spatially relative terms are intended to encompass different orientations of the element(s)/component(s), or layer(s), in use or operation, in addition to the orientations depicted in the drawings. For example, a component described as "above" another component may represent a position that is below or beside such other component with respect to alternate orientations of the subject device/assembly, and vice-versa.

In certain embodiments, the stripline 450 comprises a plurality of conductive layers that are at least partially insulated from one another by a dielectric material 455. The dielectric material 455 may comprise, for example, polyimide, Kapton, or the like. The term "dielectric material" is used herein according to its broad and ordinary meaning, and may refer to any suitable or desirable electrically and/or thermally insulating material.

The illustrated stripline 450 represents a shielded transmission line, as referenced above, which may advantageously be suitable for relatively higher frequencies without suffering unacceptable power loss and/or signal corruption. The shielding characteristics of the stripline 450 are provided at least in part by incorporation of one or more conductive planes within the stripline. For example, at least a portion of the dielectric material 455 may be disposed between first and second conductive layers 451, 453. The shielding characteristic of the stripline 450 may be particularly desirable when implemented in an installation in close proximity or contact with metal conductors, such as window frames and/or components, which may undesirably change the impedance of the stripline 450 in some embodiments.

The dielectric material 455 may further comprise an outer wrap portion that surrounds outside surfaces of the conductive layers 451, 453, and provides isolation/protection therefor. The conductive layers 451, 453 may be configured to be coupled to one or more common reference structures, such as may be components of a cable connector, circuit board, or the like. In some embodiments, the top layer 451 may be conductively coupled to the bottom layer 453. The term "conductively coupled" is used herein according to its broad and ordinary meaning, and may refer to a direct or indirect physical connection of conductive elements or components that permits conduction of a direct current signal between the elements or components.

The stripline 450 further comprises a center conductor 452 disposed between the top and bottom layers 451, 453. The center conductor may be used to communicate data and/or power, wherein the top and bottom layers 451, 453 provide radio frequency shielding for such transmission. The term "communicate" is used herein according to its broad and ordinary meaning, and may refer to either the transmitting or receiving of data and/or power signals. The center conductor 452 may be patterned in a layer of the stripline 450 or dielectric material 455. The conductive layers (451, 452, 453) may comprise any conductive material, such as copper or other metal. In some contexts, a layered dielectric/substrate portion of a cable, such as the cable 450 illustrated in FIGS. 4A-C, may be referred to as a "board," or "printed circuit board (PCB)."

The various layers of the stripline transmission line 450 may be generally uniform along at least a majority of a length L of the transmission line. Furthermore, each of the conductive layers 451, 452, 453 may be vertically offset from one another with respect to a vertical dimension of the transmission line 450, wherein the transmission line 450 has a height H in the vertical dimension. The stripline 450 may be a relatively thin. That is, the height dimension H of the stripline 450 may be relatively small compared to, for example, coaxial cables.

Figure 5:
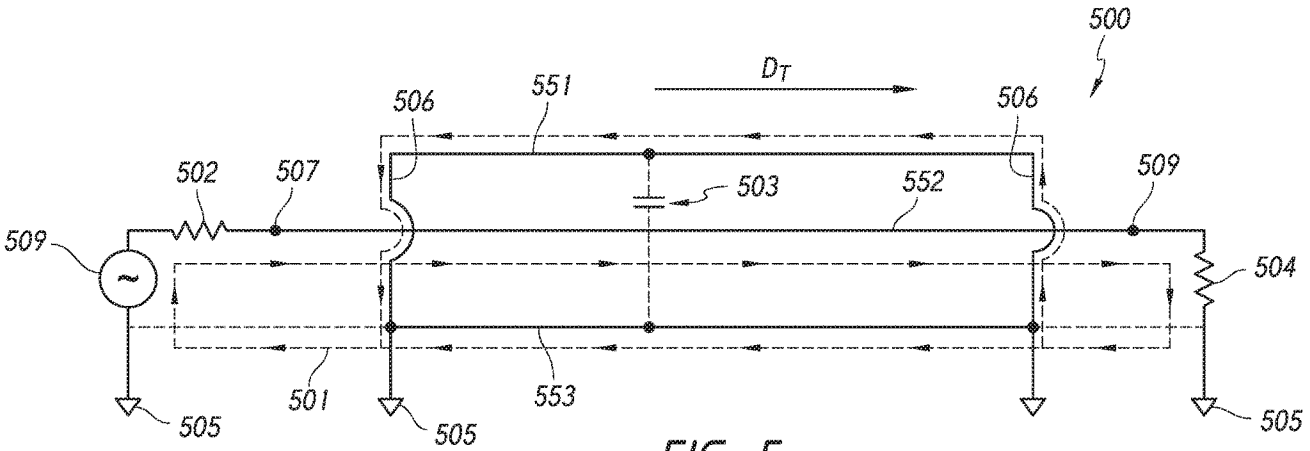
FIG. 5 is a schematic circuit diagram representing an electrical circuit associated with the stripline of FIGS. 4A-4C in accordance with one or more embodiments.

FIG. 5 is a schematic circuit diagram representing an electrical circuit 500 associated with the stripline 450 described above in connection with FIGS. 4A-4C. The circuit 500 includes top and bottom conductive layers 551, 553, and a center conductor 552. In certain embodiments, the center conductor 552 may be conductively coupled to a signal source 509 and a load 504. The top and bottom layers 551, 553 may be conductively coupled 506 to one another, or to a common reference, such that they have a substantially similar voltage potential. The dashed line 501 represents a possible flow of electrical current within the circuit 500. For example, the flow 501 may represent the flow of the signal from signal source 509 through the center conductor 552 and load 504. The ground return flow is shown as flowing through the top and bottom layers 551, 553 in a direction substantially opposite the direction of transmission DT. In certain embodiments, the electrical current flowing back through the top and bottom layers 551, 553 may be substantially split between the two layers, as each of the layers may have a similar electrical impedance. The parallel impedance of the top and bottom layers 551, 553 may effectively set the impedance of the transmission line 550, at least in part. The conductive connection between the top layer 551 and the bottom layer 553 may be a hardwired connection. Generally, a capacitance represented by the capacitor 503 may be present between the top layer 551 and the bottom layer 553. The center conductor 552 may communicate both RF and DC current in some implementations.

With further reference back to FIG. 2, the communication link 226 of the system 230 may be implementing using a stripline-type flat cable portion 250 for through-structure routing of the communication link 226. For example, the cable portion 250 may be similar in certain respects to the stripline 450 shown in FIGS. 4A-4C. For stripline-type implementations of the cable portion 250, it may be desirable or necessary for such cable portion 250 to have certain transmission line characteristics, such as controlled, defined impedance, which may help avoid unacceptable signal losses. In some implementations, the cable 250 comprises a 75-ohm connector, such that the stripline/board portion of the cable 250 may advantageously also present a 75-ohm transmission line, thereby reducing reflection and/or signal loss. However, in order to achieve a 75-ohm transmission line for the stripline-type cable, the geometry of the center conductor of the cable 250 may be undesirably narrow in some implementations, and may not be able to carry the desired DC current.

Figure 6:
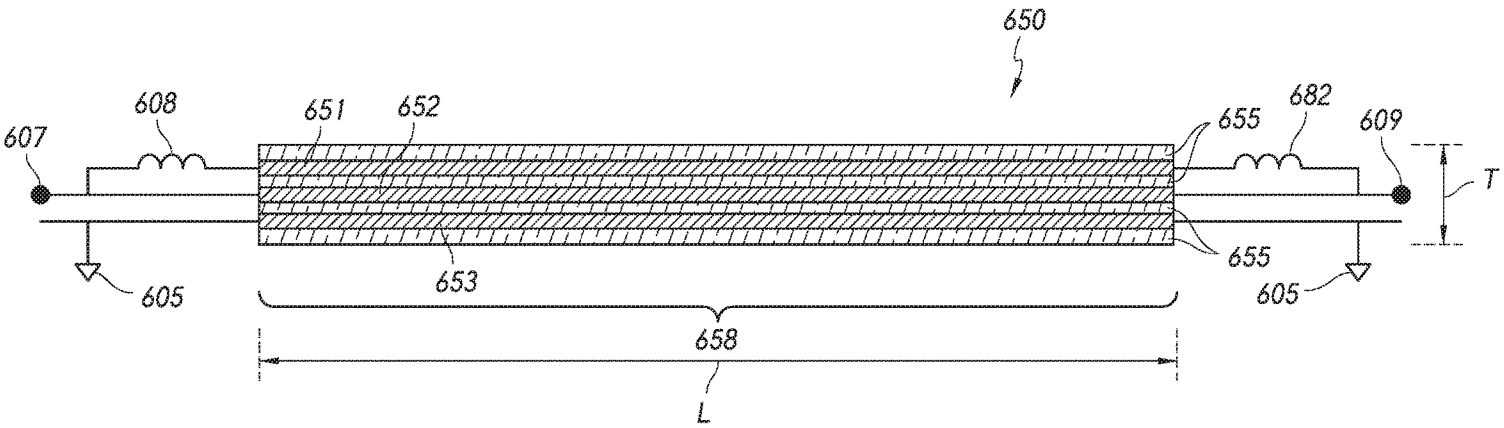
FIG. 6 illustrates an embodiment of a radio frequency (RF) transmission line in accordance with one or more embodiments.

As referenced above, for diplexed power signals communicated on center conductors of a stripline-type transmission line, the thickness and/or width dimensions of the center conductor thereof may be inadequate to adequately or safely pass the desired amount of DC power. Therefore, it may be desirable to divert at least a portion of the DC current communicated through the transmission line to another path. Some embodiments disclosed herein provide for injection of at least a portion of the DC power communicated in a stripline-type cable or transmission line into one of the outside layers of the cable/transmission line. FIG. 6 illustrates an embodiment of a radio frequency (RF) transmission line 650 in accordance with one or more embodiments. In some embodiments, the transmission line 650 comprises a transverse-electromagnetic mode (TEM) line. For example, the transmission line 650 may be considered a TEM transmission line due to its two-conductor configuration, wherein a center conductor 652 constitutes a first conductor, and one or more of the outer conductive layers 651, 653, either collectively or individually, constitutes a second conductor, which may allow for restriction of electric and magnetic field lines to transverse orientations with respect to the direction of signal transmission. In certain embodiments, the top layer 651 and the bottom layer 653 are capacitively coupled, thereby allowing for the two layers to collectively provide the second conductor for TEM mode operation. The terms "cable" and "transmission line" are used herein according to their broad and ordinary meanings. In some contexts, the terms "cable," "cable portion," "cable assembly," "transmission line," transmission line portion," and "transmission line assembly" may be used substantially interchangeably herein to refer to any physical transmission line, or portion thereof, and may encompass certain features associated therewith, such as boards, connectors, conductors, substrates/insulators, vias, and discrete devices or elements, such as inductors, resistors, capacitors, or the like, as well as certain structural features.

The transmission line 650 may be at least partially embodied in an RF cable, or portion thereof, in accordance with one or more embodiments disclosed herein. The transmission line 650 includes a board/substrate portion 658, as well as one or more connections thereto, which are illustrated in schematic circuit diagram representation in FIG. 6. The board/substrate portion 658 may comprise dielectric material. The terms "substrate" and "substrate portion" are used herein according to their broad and ordinary meanings, and may refer to any supporting material or structure on which one or more conductors, conductive layers, and/or other passive or active circuit elements may be formed, fabricated, or disposed. The transmission line 650 comprises a plurality of conductive layers, namely a top conductive layer 651, a bottom conductive layer 653, and a center conductor 652. The illustrated layers may be similar in some respects to the various layers of the stripline shown in FIGS. 4A-4C and described above. The transmission line 650 may comprise a dielectric material 655, which may be substantially lossless in some implementations. In certain embodiments, the cross-section of the board/substrate portion 658 of the transmission line 650 may be substantially constant along at least a majority of the length L of the transmission line.

The center conductor 652 may be conductively coupled to a node 607, which may be configured to receive one or more electrical signals, such as a diplexed DC power and RF data signal. The top layer 651 may be isolated from the node 607 and/or center conductor 652 with respect to high-frequency signals through the insertion of an RF choke element 608, such as an inductor, or other low-pass-filter-type element configured to substantially block RF signals from propagating therethrough from the node 607 to the top layer 651. However, the top layer 651 may be conductively coupled to the node 607 and/or center conductor 652 with respect to low-frequency signals. That is, DC signals may be permitted to pass at least in part through the RF choke elements 608 to the top layer 651 substantially unattenuated. In order to allow for DC signals to pass from the node 607 to the top layer 651, while substantially blocking the passage of RF signals, the RF choke element 608 may advantageously have a relatively low (e.g., approximately zero) DC impedance, while presenting a relatively high (e.g., approximately infinite) RF impedance. The RF choke element 608 may comprise one or more printed and/or discrete-component inductors, or the like. In certain embodiments, the RF choke element 608 comprises a band-stop filter configured to block signals within a frequency band of interest. In certain embodiments, the RF choke element 608 comprises a low-pass filter comprising one or more capacitors, inductors, and/or other discrete circuit elements. In one embodiment, the RF choke element 608 comprises a single inductor wound on a high frequency, high saturation flux ferrite core, the inductor having relatively large inductance, high self-resonant frequency and/or high Q characteristics, thereby achieving relatively low cut-off frequency and low RF losses.

The coupling of the first layer 651 to the center conductor 652 may be implemented at or near a first distal end of the board portion 658. Furthermore, in some embodiments, the transmission line 650 further includes an additional RF choke element 682 conductively coupled between the center conductor 652 and the top layer 651 at a second distal end of the board/substrate portion 658, as shown. The DC coupling between the top layer 651 and the center conductor 62 may enable at least a portion of a DC signal present on the node 607 to be communicated through the top layer 651, and returned through the bottom layer 653.

When a signal is received at the node 607 comprising a DC component and an RF component, substantially all of the RF component, as well as a portion of the DC component, may be communicated on the center conductor 652, while a portion of the DC component may be communicated on the top layer 651 through the RF choke element 608. In certain embodiments, the majority of the DC component of the signal is communicated on the top layer 651, which may present substantially less impedance than the center conductor 652 from the perspective of the node 607. It may be desirable to route the DC signal component, or at least a portion thereof, to the top layer 651 in situations in which the center conductor 652 provides insufficient current-handling capability, as described above. The bottom layer 653 may provide a ground return for both the DC and RF components of the signal.

In certain embodiments, the top layer 651 is conductively isolated from the bottom layer 653 with respect to low-frequency signals. However, capacitive coupling between the top layer 651 and the bottom layer 653 may allow for communication of RF signals between the top layer 651 and the bottom layer 653. Therefore, through capacitive coupling of the top and bottom layers 651, 63, the top and bottom layers may provide a ground return path for RF signals communicated on the center conductor 652. That is, the capacitive coupling between the top layer 651 and the bottom layer 653 may allow for the top layer 651 to provide a "virtual" RF ground plane for the cable 650. Therefore, the top conductive layer 651, bottom conductive layer 653, and central conductor 652 together may define the RF transmission line that carries the RF component of the signal source. The term "conductively isolated" is used herein according to its broad and ordinary meaning. For example, as used herein, elements or components that are "conductively isolated" are not physically connected to one another, such that a direct current signal is not intended to conduct between the elements or components.

Figure 7A:
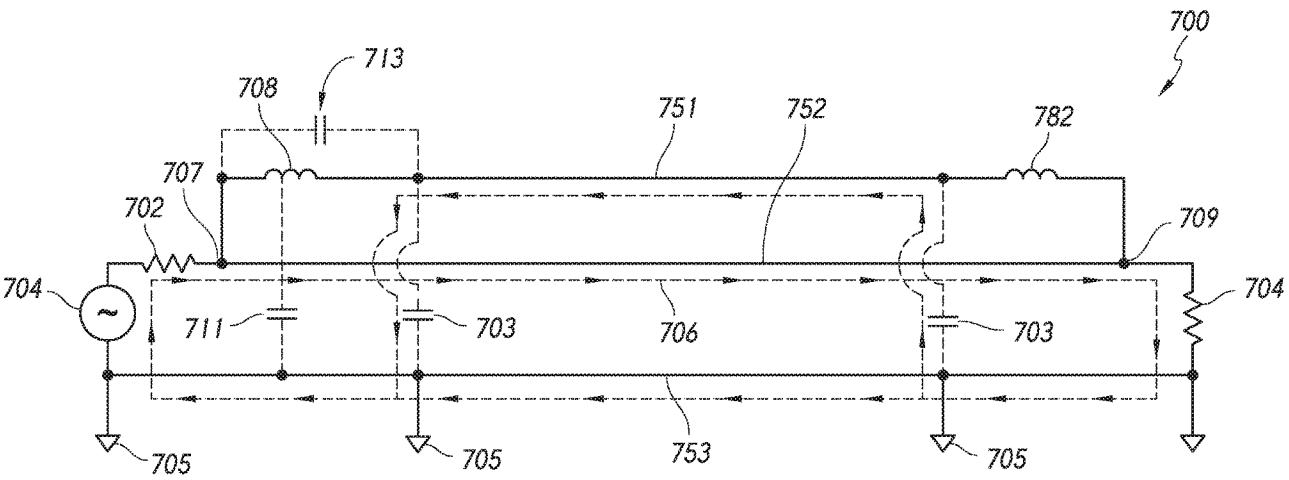
FIGS. 7A and 7B are schematic circuit diagrams representing electrical circuits associated with the transmission line of FIG. 6 in accordance with one or more embodiments.

FIG. 7A is a schematic circuit diagram representing an electrical circuit 700 associated with the transmission line 650 described above in connection with FIG. 6. The circuit 700 illustrates a signal source 704, which may correspond to a signal received at node 607 with respect to the transmission line 650 of FIG. 6. The circuit 700 may effectively implement diplexer functionality with respect to the signal source 704. For example, the signal source 704 may comprise a direct current (DC) component and a radio frequency (RF) component, wherein the connection of the radio frequency choke element 708 to the center conductor line 752 at the node 707 may serve to pass the DC component, or at least a portion thereof, to the top layer conductor 751, and block the RF component from passing to the top layer 751, and further allow for passage of the RF component along the center conductor 752, while effectively at least partially blocking the DC component of the signal from passing along the center conductor 752 due to the substantially higher impedance of the center conductor 752 relative to the top layer conductor 751.

With further reference to FIG. 6, as described above, parasitic capacitances may be present between the top layer 651 and the bottom layer 653, and further between the top layer 651 and the center conductor 652 and between the center conductor 652 and the bottom layer 653. Such capacitances may at least partially set the impedance of the transmission line 650. The capacitance between the top plate 651 and the center conductor 652, with respect to high-frequency signals (e.g. radio frequencies), may effectively short the top layer 651 to the center conductor 652, such that the high-frequency signal may flow through the top layer 651. Further, the capacitance between the top layer/plane 651 and the bottom layer/plane 653 may allow the ground return signal for the high-frequency signal to jump from the bottom layer 653 to the top layer 651 and be distributed through both layers. Such behavior is shown in the circuit 700 of FIG. 7A, wherein the high-frequency signal flow 706 is illustrated as propagating down the center conductor 752, to the load 704, and back as a ground return signal that is distributed, via the capacitance 703 between the top 751 and bottom 753 layers, across such layers. That is, as compared to a traditional stripline transmission lines, rather than conductively spreading the ground return signal across both the top and bottom layers, in the embodiments illustrated in FIGS. 6 and 7A, the signal is spread across the top and bottom layers capacitively.

Figure 7B:
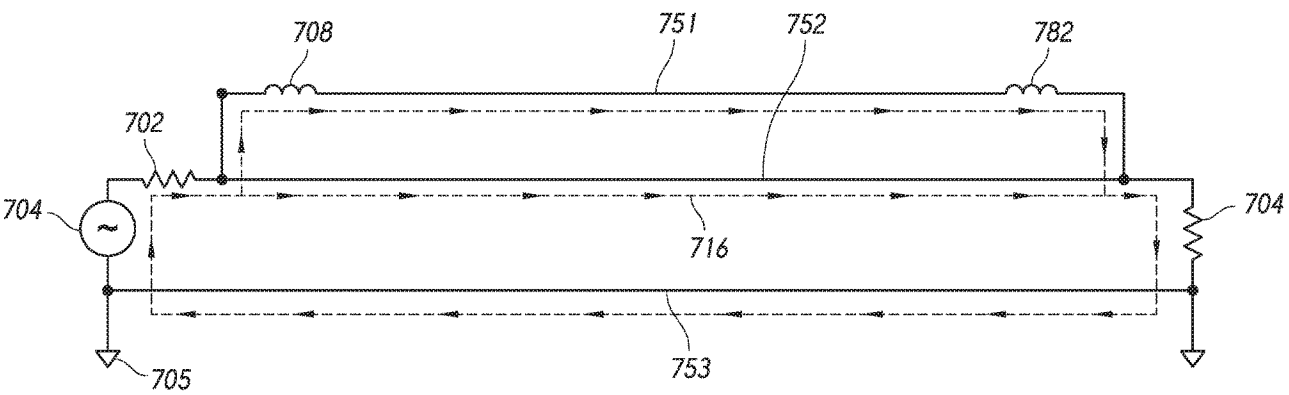

FIG. 7B is a schematic circuit diagram illustrating the low-frequency signal flow 716 of the circuit 700 in accordance with one or more embodiments of the present disclosure. The low-frequency signal flow 716 is illustrated as propagating from the source to the top layer 751 through the RF choke element 708. At least a portion of the low-frequency signal is also shown as passing through the center conductor 752, although the majority of the low-frequency signal may advantageously pass along the top layer 751 is some embodiments. The ground return signal for the low-frequency flow 716 may pass along the bottom connector 753. In certain embodiments, the low-frequency (e.g., DC) ground return signal may be constrained to the bottom layer 753, and not be spread to the top layer 751, due to the top layer 751 being conductively isolated from the bottom layer 753.

The implementation of FIGS. 6 and 7A/7B may advantageously allow for conductive isolation of the top layer 651, 751 from the bottom layer 653, 753, thereby allowing for DC isolation between the top layer 651, 751 and the bottom layer 653, 753, wherein DC power may be injected into the isolated top layer 651, 751. For example, the top layer 651 may have a DC voltage potential that is different than the DC voltage potential of the bottom layer 653. In one embodiment, the DC voltage potential of the top layer 651 may be approximately 48 V, while the DC voltage potential of the bottom layer 653 may be substantially 0 V. Heat dissipation may further be improved due to the position of the top layer 651 on the outside of the cable 650, such that heat generated therein may more readily be dissipated than heat generated in, for example, the inner conductor 652.

Unlike traditional stripline transmission lines, the top layer 651 is not conductively coupled to the bottom conductive layer. Since both the top layer 651 and the bottom layer 653 may advantageously be relatively wide, a relatively low impedance may be achieved, which may enable high current-carrying capability. In some embodiments, the width of the top layer 651 and/or bottom layer 653 may be greater than typical in stripline transmission lines in order to compensate for the top layer 651 not being hardwired to the bottom layer 653. In some embodiments, the top layer 651 and/or bottom layer 653 may be approximately 0.5 inches wide. Due to the relatively wide nature of the top layer 651 and bottom layer 653, such layers may advantageously comprise thin copper, or other electrically conductive material, rather than thicker conductors. For example, the width of the outer layer 651, 653, may provide relatively low resistance, which may enable high power-carrying capability of the outer layers. Furthermore, the center conductor 652 may carry only a relatively small amount of DC power, and may therefore also permissibly be relatively thin. The thin characteristic of the conductors may allow for a relatively thin overall thickness T of at least the board portion 658 of the cable 650. For example, in certain embodiments, 0.5-oz copper (e.g., having 0.7-mil thickness) may be used for one or more of the conductive layers of the transmission line 650, providing an overall thickness for the board portion 658 of the transmission line 650 approximately 20 mils, or less. Furthermore, thinner material for the center conductor 652 may also provide improved etching tolerance compared to thicker conductors.

Figure 8:
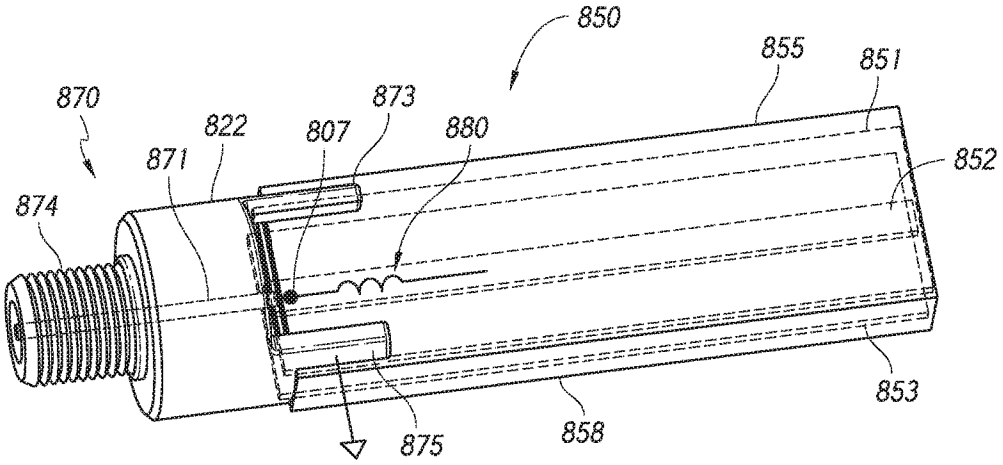
FIG. 8 illustrates a perspective view of a portion of a flat cable in accordance with one or more embodiments.

As referenced above, in certain embodiments, the center conductor 652 may be used to carry only a relatively small amount of DC power, which may allow for the center conductor 652 to be relatively narrow, thereby achieving relatively low capacitance between the center conductor 652 and the top 651 and/or bottom 653 layers. Such features may advantageously enable relatively-higher transmission line impedance (e.g., 75 ohms), while allowing for a relatively thin profile T of the cable. In one embodiment, a capacitor (not shown) may be inserted in series with the center conductor 652 on each end of the cable 650, which may be used to substantially completely remove DC signal from the center conductor 652. In another embodiment, a shunt capacitor (not shown) may be added from the top layer 651 to the bottom layer 653 at one or more ends or regions of the transmission line 650 to improve filter out any residual RF energy that may pass through the RF choke element 608, as well as to electromagnetic interference shielding. The implementation of the shunt capacitor may include adding a via to connect the bottom layer to the capacitor's pad on the top layer, to which one terminal of the capacitor is soldered, with the other capacitor's terminal soldered to the pad on the top layer FIG. 8 illustrates a perspective view of a portion of a flat cable 850 in accordance with one or more embodiments. The cable 850 includes a board portion 858 and a connector portion 870. For example, the connector portion 870 may comprise a coaxial-type F-connector. The connector portion 870 may comprise a center pin feature 871, which may be disposed in-line with a central axis of the connector portion 870. The connector portion 870 further comprise a male (or female) engagement portion 874, which may comprise a threaded projection, as shown. The connector portion 870 may further comprise one or more leg members 873, 875, which may provide a ground reference for the cable 850 and/or board portion 858. In certain embodiments, the center pin 871 may be conductively coupled to a mid-layer center trace/conductor 852, as described in detail herein. Furthermore, the cable 850 may include a radio frequency (RF) choke element 880 (illustrated as a schematic representation) conductively coupled to the center conductor 852 and the conductive top layer 851, as described above. The cable 850 may further comprise a bottom layer 853, which may provide a ground reference plane for DC and RF transmissions in the cable 850. The various layers of the board portion 858 of the cable 850 may be separated and/or supported by dielectric material 855. In certain embodiments, the board portion 858 of the cable 850 may be at least partially flexible, and may advantageously have a thickness that is suitable for installation in/under a window or door installation, as described above.

Figure 9:
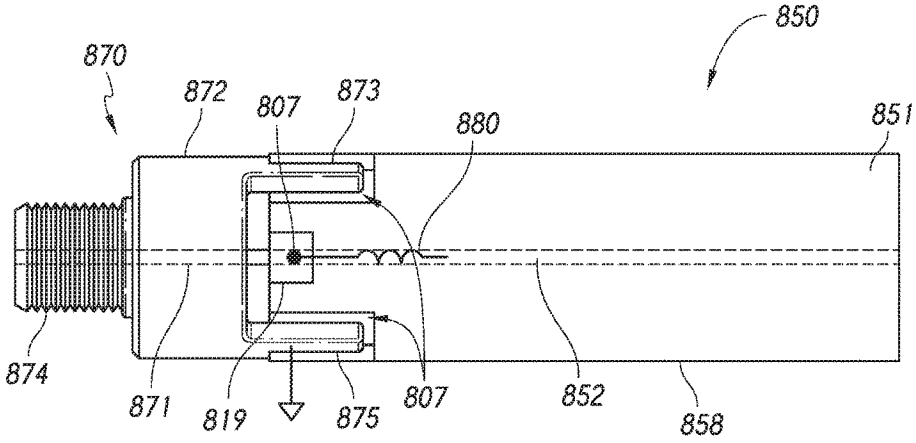
FIG. 9 illustrates a top view of the flat cable shown in FIG. 8 according to one or more embodiments.

FIG. 9 illustrates a top view of the cable 850 shown in FIG. 8. The diagram of FIG. 9 illustrates that, although the bottom conductive layer 853 may be coupled to a ground reference, such as to the leg(s) of the F-connector 870, in certain embodiments, the top layer 851 may be conductively isolated from the legs 973, 975 of the connector structure 970, as shown. For example, etched gaps 807 may isolate the top layer 851 from the connector 870. Furthermore, in certain embodiments, a portion of the top layer 851 may be etched away to form an opening 819, which may at least partially reduce parasitic capacitances between the center pin via pad 807 and the ground reference.

Figure 10:
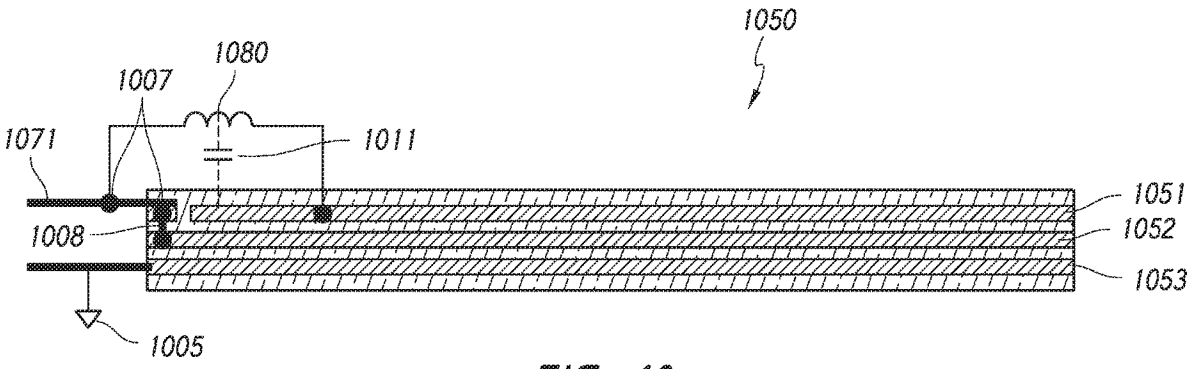
FIG. 10 illustrates a cross-sectional side view of a portion of a flat RF transmission cable incorporating an RF choke inductor according to one or more embodiments.

As described herein, certain embodiments of the present disclosure utilize radio frequency (RF) choke (e.g., inductor) elements on one or more ends of a stripline-type transmission line, wherein the RF choke is used to pass DC current to the top layer of the transmission line, while blocking the propagation of RF signal therethrough. FIG. 10 illustrates a cross-sectional side view of a portion of a flat RF transmission cable 1050 incorporating a RF choke inductor 1080 according to one or more embodiments. The cross-sectional view of FIG. 8 may be with respect to a centerline of the cable 1050 with respect to a width of the cable 1050. In certain embodiments, the cable 850 constitutes a transmission line, such as a transverse-electromagnetic mode (TEM) transmission line.

As illustrated, an RF choke element 1080 may be coupled to a top conductor/layer 1051 of the cable 1050, such that the inductor 1080 is physically disposed above the top layer 1051, or at least a portion thereof. The inductor 1080 may be conductively coupled at a first end to the top layer 1051, and at a second end to a node 1007 associated with a signal transmission pin 1071, or the like. In some embodiments, the signal transmission pin 1071 may be a center signal pin of a coaxial cable F-connector. Due to the physical disposition and/orientation of the inductor above the top conductive layer 1051, a parasitic capacitance, which is illustrated as the capacitance 1011 in the diagram for clarity purposes, may be present between the inductor 1080 and the top layer 1051. In certain embodiments, the parasitic capacitances 1011 may result in degraded performance due to insertion loss and/or impedance/return loss degradation at higher frequencies. The parasitic capacitances of the inductor 1080 may be dependent at least in part on the parameters and/or characteristics of the inductor 1080. For example, for relatively larger-coil inductors, greater parasitic capacitances may be present. Furthermore, the greater the length of the inductor 1080, the more DC power and/or RF losses may be introduced by the windings of the inductor. In addition, the presence of a magnetic core (e.g., ferrite core), and/or the permeability thereof, may results in losses. Therefore, the inductor size and/or characteristics may be selected in order to provide optimal RF signal blocking vis-à-vis insertion losses.

The bottom layer 1053 may provide a relatively solid, continuous conductive plane that may be coupled to a ground reference 1005. In certain embodiments, the center pin 1071 may be coupled to a pad 1007, which may be conductively coupled to the center conductor 1052 through a through-substrate via 1008. In certain embodiments, parasitic capacitances exist between the center pin via pad 1007 and the ground reference. The center pin 1071 may be conductively coupled to the pad 1007 in any suitable or desirable manner, such as through soldering or the like.

Although the top layer 1051 may be physically isolated from the bottom layer 1053, due to capacitive coupling between the top layer 1051 and the bottom layer 1053, the top layer 1051 may be considered a ground, or virtual ground, with respect to RF signals; the voltage potential of the top layer 1051 may be essentially the same as that of the bottom layer 1053 for high-frequency signals. In certain embodiments, the capacitance between the top layer 1051 and the bottom layer 1053 may be approximately 400 pF, or more.

In some implementations, insertion loss associated with the inductor 1080 may result in unwanted leaking of at least a portion of the RF signal communicated on the pin 1071 into the top layer 1051. That is, due to the parasitic capacitances 1011, rather than blocking substantially all of the RF component of the communicated signal, the inductor may allow for at least a portion thereof to be passed to the top layer 1051. The parasitic capacitances 1011 between the inductor 1080 and the top layer 1051 may degrade performance of the transmission line 1050, as well as the impedance thereof, and/or increase internal losses and insertion loss.

Figure 11:
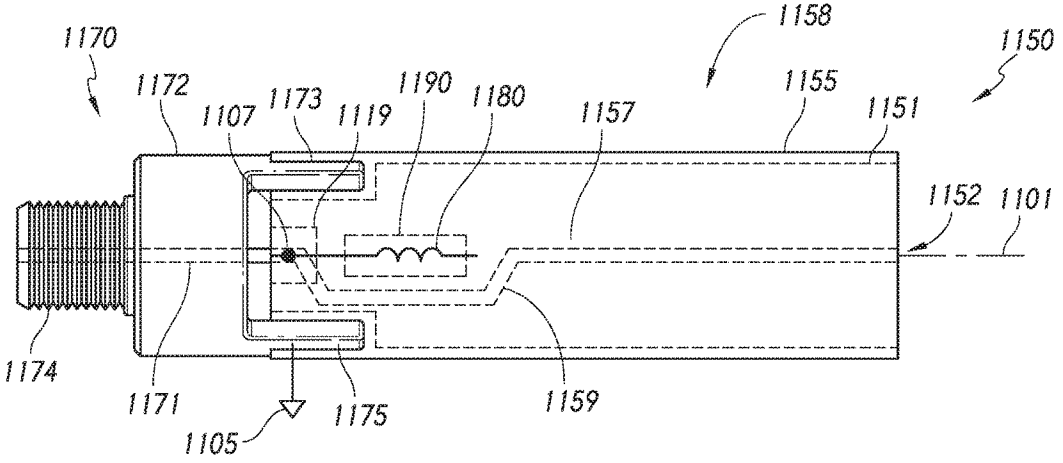
FIG. 11 illustrates a top view of a portion of a flat cable in accordance with one or more embodiments.

Parasitic capacitance between the inductor 1080 and the top layer 1051 may depend at least in part on the distance between the inductor 1080 and the conductor 1051. Therefore, in some implementations, it may be desirable to remove at least a portion of the conductor 1051 to increase the distance between the inductor 1080 and conductive elements of the cable 1050. FIG. 11 illustrates a top view of a portion of a flat cable 1150 in accordance with one or more embodiments. The cable 1150 may be configured to at least partially reduced parasitic capacitance associated with the inductor 1180, which may be conductively coupled to a top plane 1151 and/or center conductor 1152 accordance with embodiments disclosed herein. In the embodiment of FIG. 11, a window or opening 1190 may be etched or removed from the top conductive layer 1151 and/or bottom ground layer (not shown) in order to reduce parasitic capacitances associated with the inductor 1180. It may be desirable to remove the conductive material in both the top plane 1151 and bottom plane (not shown) as far as practical or possible from the coil 1180 to form the window opening 1190. From the perspective of FIG. 11 looking down on the cable 1150, the opening 1190 may comprise substantially only dielectric material therein. The size and/or location of the opening 1190 may be designed to optimize performance of the cable 1150.

Depending on the position of the opening 1190, the presence of the opening may create a ground discontinuity with respect to the center conductor 1152 if the center conductor is routed through the window of the opening 1190. Such ground discontinuity may at least partially disturb the impedance of the cable 1150. That is, the presence of the opening 1190 introduces the potential for impedance discontinuity, which may potentially reduce signal integrity. Therefore, in certain embodiments, the conductive trace 1152 may be routed at least partially around the opening 1190, such that the opening does not vertically overlap (i.e., into or out of the page with respect to the orientation of the cable 1150 in FIG. 11) the center conductor 1152. The center conductor 1152 may advantageously be routed such that ground conductor is present both on top and below the center conductor 1152 along the entire length thereof in order to maintain proper impedance for the transmission line. As shown, in one embodiment, the center conductor has a straight portion 1157 and a re-routed portion 1159. Although one embodiment is illustrated in FIG. 11 in which the inductor runs substantially parallel and along a centerline or longitudinal axis 1101 of the cable 1150, wherein the center conductor 1152 is routed away from the centerline 1101 laterally, as shown, it should be understood that any suitable or desirable positioning of the opening and/or routing of the conductor 1152 may be implemented in accordance with the embodiments of the present disclosure. For example, in one embodiment, the inductor 1180 and opening 1190 may be angled with respect to the centerline/longitudinal axis 1101 of the cable, wherein the center conductor 1152 may run substantially continuously along the centerline 1101. That is, in some implementations, it may not be necessary to re-route the center conductor away from the centerline 1101 in order to avoid vertical overlap with the window 1190.

The inductor 1180 may be coupled to the center pin 1171 of the connector portion 1170 via a conductive connection 1107. The inductor 1180 may comprise a surface-mounted inductor. In certain embodiments, it may not be practical or desirable to solder or couple the inductor 1180 directly to the center conductor 1152, and therefore conductive coupling may be achieved between the inductor 1180 and the center conductor 1152 through a through-substrate via and/or pad configuration. Although conductor openings are described herein, it should be understood that in some implementations, parasitic capacitance may be reduced through conductor hashing, wherein the conductor in the relevant area is not removed entirely, but rather patterned segments thereof may be removed.

Figure 12:
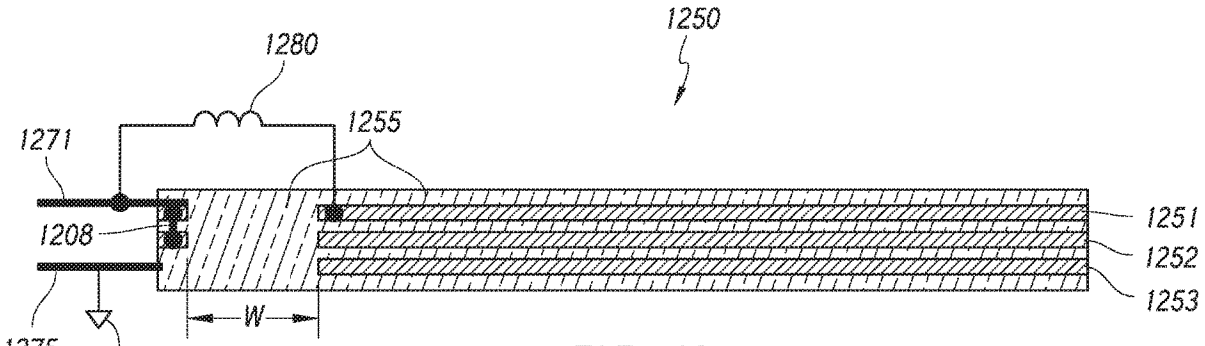
FIG. 12 illustrates a cross-sectional side view of at least a portion of a flat cable in accordance with one or more embodiments.

FIG. 12 illustrates a cross-sectional side view of at least a portion of a flat cable 1250 in accordance with one or more embodiments disclosed herein. The cross-section represented in FIG. 12 may be, for example, along a centerline of the cable 1250, which may constitute a transmission line 1250, such as a transverse-electromagnetic mode (TEM) line. The cable 1250 may provide parasitic capacitance reduction with respect to the inductor 1280 through the removal of conductive material and/or ground plane regions underneath the inductor 1280, as described above in connection with FIG. 11. Furthermore, impedance of the cable 1250 may be maintained through the re-routing/relocating of the center trace 1252 around the opening in the top layer 1251 and/or bottom layer 1253 formed through conductor removal. For example, as shown, the center conductor 1252 may not be present at the centerline portion of the cable 1250 at least in the window W in the longitudinal direction of the cable 1250. The inductor 1280 may be coupled to a connector pin 1271 of, for example, an F-connector, as described herein. Conductive coupling of the inductor 1280 to the center conductor 1252 may be made using a through-substrate via 1208, as shown. The connector structure 1275 may be conductively coupled to the bottom layer 1253, thereby grounding the bottom layer 1253.

Figure 13:
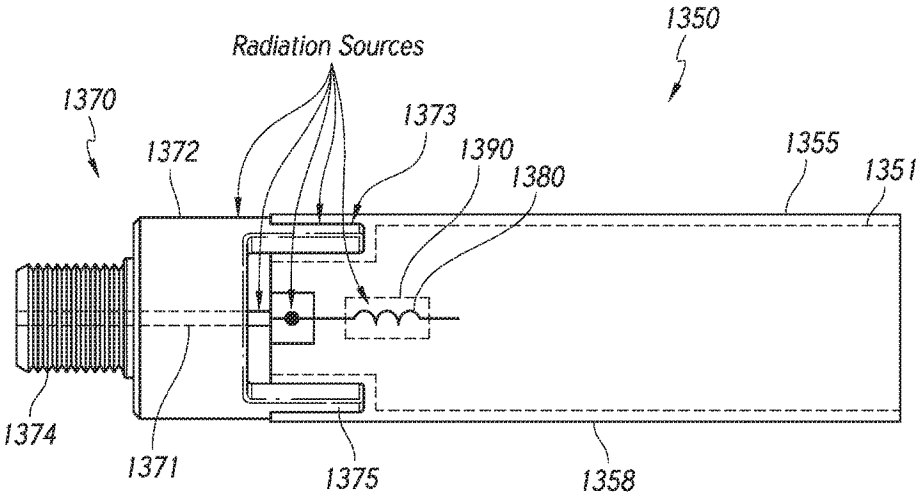
FIG. 13 illustrates a top view of a flat cable in accordance with one or more embodiments.

FIG. 13 illustrates a top view of a flat cable 1350 in accordance with one or more embodiments disclosed herein. In certain embodiments, a flat cable configured for data and/or power transmission may include one or more sources of radiated spurious emissions, which may adversely affect the performance of the cable. For example, the illustrated cable 1350 comprises a connector portion 1370 having a connector pin 1371, and a plurality of ground-connection legs 1373, 1375. The cable 1350 may further comprise an inductor 1380 implemented as a radio frequency (RF) choke element that is conductively coupled to one or more of a top conductive layer 1351 and/or center conductor (not shown) in accordance with the present disclosure. In certain embodiments, undesirable radiation may emanate from one or more of the center pin 1371 of the connector structure 1370, the gap between the connector structure 1370 and the board/substrate portion 1358 of the cable 1350, the inductor 1380, the edge of the board/substrate portion 1358 around the legs 1373, 1375 of the connector structure 1370, and/or other components or regions of the cable 1350. For example, with respect to the inductor 1380, radiation may emit from the coil body, which may act as an antenna to radiate emissions.

Figure 14:
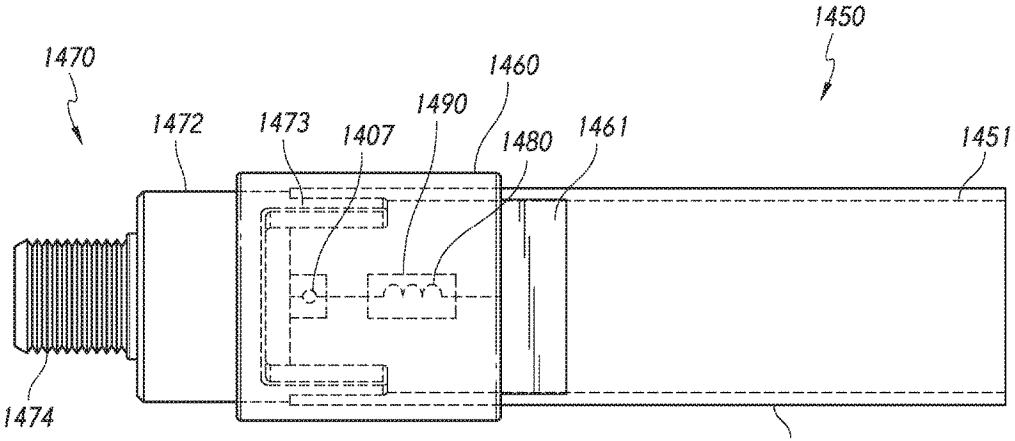
FIG. 14 illustrates a top view of a flat cable assembly in accordance with one or more embodiments.

FIG. 14 illustrates a top view of a flat cable assembly 1450 in accordance with one or more embodiments disclosed herein. The cable assembly 1450 comprises a shield structure 1460, which may be configured to provide shielding to prevent ingress and/or egress of radiation from the sources shown in FIG. 13 and described above. For example, the shield structure 1460 may have a generally-cylindrical shape, and may be configured to encompass one or more of the components of the cable assembly 1450, such as the inductor 1480. The shield structure 1460 may advantageously comprise conductive material, such as metal (e.g., copper, or the like). In certain embodiments, the shield structure 1460 further comprises a lip extension or form 1461, which may rest on a top surface of the board portion 1458 of the cable assembly 1450. The lip 1461 may be configured to capacitively couple to the top plane 1451 of the cable assembly 1450.

Figure 15:
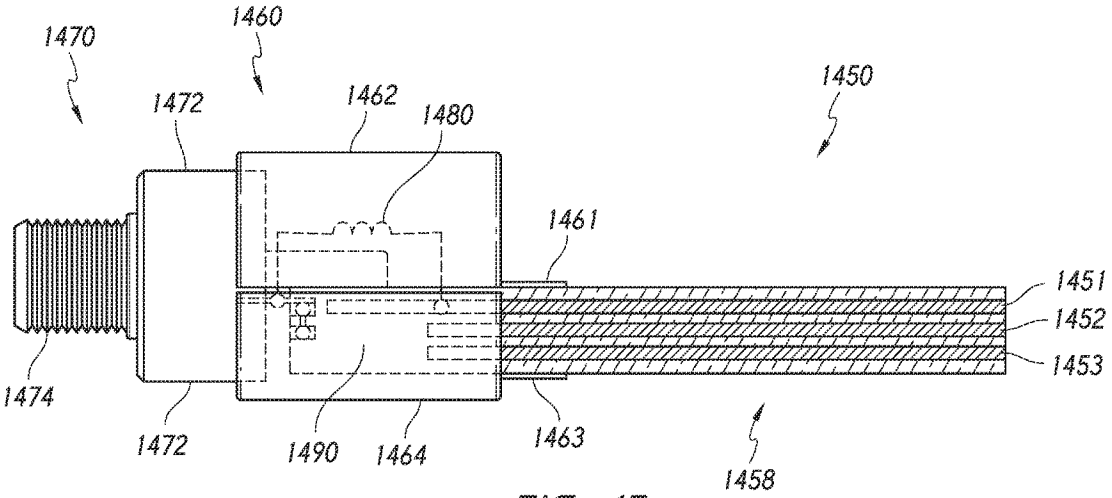
FIG. 15 illustrates a side view of the flat cable assembly of FIG. 14 in accordance with one or more embodiments.

FIG. 15 illustrates a side view of the flat cable assembly 1450 of FIG. 14. As shown in FIG. 15, the cable assembly 1450 may comprise an upper portion 1462 and a lower portion 1464. Although two separate portions are illustrated, in some embodiments, the shield structure 1460 comprises a single integrated structure or form. In certain embodiments, the bottom portion 1464 may be directly or capacitively coupled to the bottom conductive layer 1453 of the cable assembly. For example, in certain embodiments, a lip structure or form 1463 of the bottom portion 1464 may be soldered to the board 1458 and/or bottom layer 1453. Alternatively, the lip 1463 may be capacitively coupled to the bottom layer 1453, which may provide a ground plane. The top portion 1462 may also comprise a lip structure or form 1461. However, in embodiments in which the bottom lip 1463 is soldered or otherwise directly conductively coupled to the bottom layer 1453, it may not be suitable for the upper lip 1461 to be soldered or directly coupled to the top layer 1451, as such connection may result in an undesirable DC short between the top layer 1451 and the bottom layer 1453. The length of the upper and/or lower lip portions 1461, 1463 may be designed to provide desired coupling between the lip(s) and the respective conductive layer.

The bottom shield portion 1464 may be physically coupled to the body of the connector portion 1470 to provide grounding therefore. In certain embodiments, the edges of the shield structure 1460 rest on the surfaces of the board 1458. In some embodiments, the top portion 1462 and bottom portion 1464 of the shield structure 1460 are coupled together.

Figure 16:
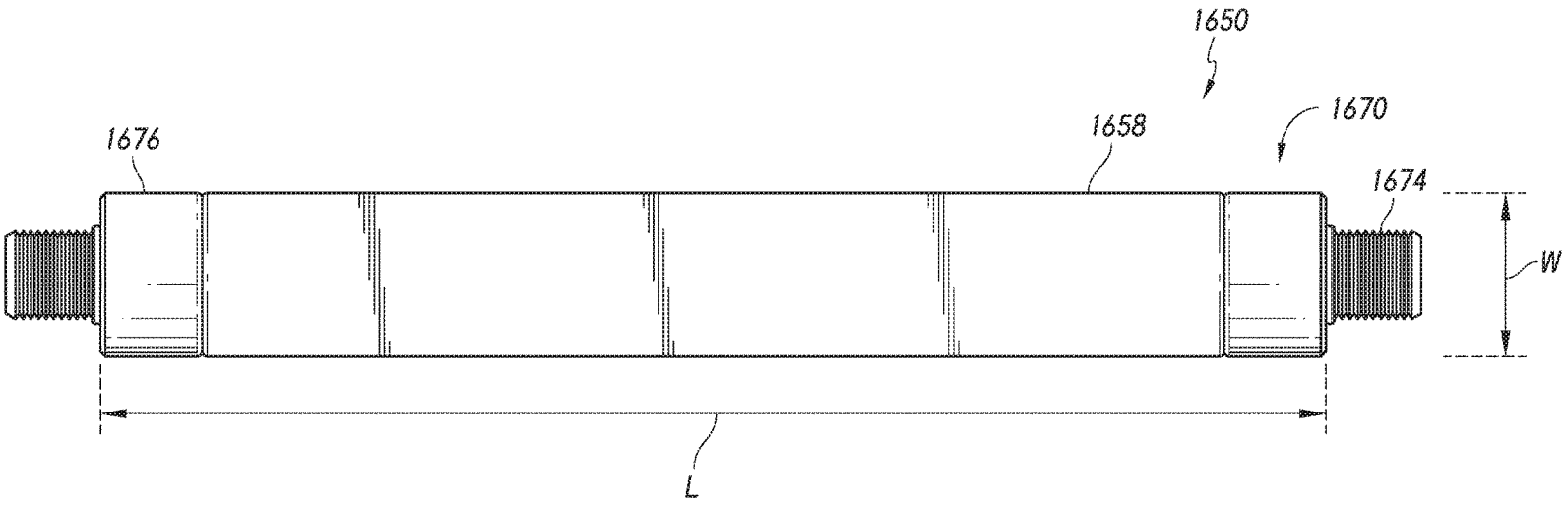
FIG. 16 illustrates a top view of a flat cable assembly in accordance with one or more embodiments.
Figure 17:
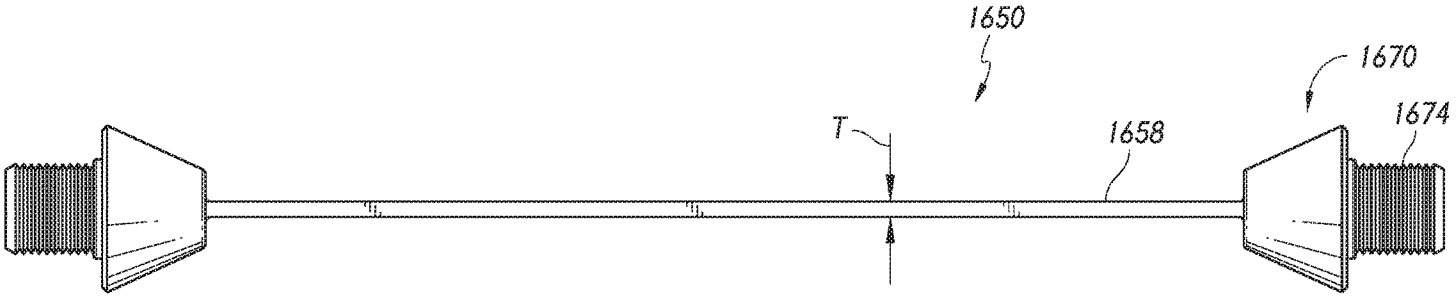
FIG. 17 provides a side view of the cable assembly shown in FIG. 16 according to one or more embodiments.

FIG. 16 illustrates a top view of a flat cable assembly 1650 in accordance with one or more embodiments disclosed herein. FIG. 17 provides a side view of the cable assembly 1650 shown in FIG. 16. The cable assembly 1650 includes over mold portions (e.g., 1676) covering components of the cable assembly 1650 at distal ends thereof. The over mold portions of the cable assembly 1650 may comprise weatherproof structure for protecting internal components associated with the distal ends of the cable assembly 1650. The cable assembly 1650 comprises connector portions 1670 and a flexible board portion 1658. For example, the board portion 1658 may comprise a three-layer flexible printed circuit board (PCB). Furthermore, the connector portion 1670 may comprise an F-connector having a mating portion 1674 that is compatible with, for example, a coaxial cable connector. Certain dimensions of the cable assembly 1650 are illustrated in the diagrams of FIGS. 16 and 17. For example, in certain embodiments, the cable assembly 1650 may have a length L of approximately 10 inches, or any other suitable or desirable value. Furthermore, the cable assembly 1650 may have a width W of approximately 0.5 inches, or any other suitable or desirable value. Furthermore, the cable assembly 1650 may advantageously comprise a relatively thin flexible board portion 1658. For example, the board portion 1658 may advantageously have a thickness T of approximately 20 mills, or less, which may be suitable for installation in certain window/door installations.

General Comments

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." The word "coupled", as generally used herein, refers to two or more elements that may be either directly connected, or connected by way of one or more intermediate elements. Additionally, the words "herein," "above," "below," and words of similar import, when used in this application, shall refer to this application as a whole and not to any particular portions of this application. Where the context permits, words in the above Description using the singular or plural number may also include the plural or singular number respectively. The word "or" in reference to a list of two or more items, that word covers all of the following interpretations of the word: any of the items in the list, all of the items in the list, and any combination of the items in the list.

Reference throughout this disclosure to "some embodiments," "certain embodiments" or "an embodiment" means that a particular feature, structure or characteristic described in connection with the embodiment can be included in at least some embodiments. Thus, appearances of the phrases "in some embodiments," "in certain embodiment," or "in an embodiment" in various places throughout this specification are not necessarily all referring to the same embodiment, and may refer to one or more of the same or different embodiments. Furthermore, embodiments disclosed herein may or may not be embodiments of the invention. For example, embodiments disclosed herein may, in part or in whole, include non-inventive features and/or components. In addition, the particular features, structures or characteristics can be combined in any suitable manner, as would be apparent to one of ordinary skill in the art from this disclosure, in one or more embodiments.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while processes or blocks are presented in a given order, alternative embodiments may perform routines having steps, or employ systems having blocks, in a different order, and some processes or blocks may be deleted, moved, added, subdivided, combined, and/or modified. Each of these processes or blocks may be implemented in a variety of different ways. Also, while processes or blocks are at times shown as being performed in series, these processes or blocks may instead be performed in parallel, or may be performed at different times.

The teachings of the invention provided herein can be applied to other systems, not necessarily the system described above. The elements and acts of the various embodiments described above can be combined to provide further embodiments.

While some embodiments of the inventions have been described, these embodiments have been presented by way of example only, and are not intended to limit the scope of the disclosure. Indeed, the novel methods and systems described herein may be embodied in a variety of other forms; furthermore, various omissions, substitutions and changes in the form of the methods and systems described herein may be made without departing from the spirit of the disclosure. The accompanying claims and their equivalents are intended to cover such forms or modifications as would fall within the scope and spirit of the disclosure.

What is claimed is:

1. A radio frequency (RF) transmission line comprising:

a first conductive layer;

a second conductive layer conductively isolated from the first conductive layer;

a center conductor disposed between the first conductive layer and the second conductive layer;

dielectric material disposed between the first conducive layer and the second conductive layer and at least partially surrounding the center conductor; and an RF choke element that conducts a direct current signal between the center conductor and the second conductive layer.

2. The RF transmission line of claim 1, wherein the RF choke element comprises an inductor having a first end conductively coupled with the second conductive layer and a second end conductively coupled to the center conductor.

3. The RF transmission line of claim 1, wherein the RF transmission line has a characteristic impedance defined by the first conductive layer, the second conductive layer, the center conductor and the dielectric material.

4. The RF transmission line of claim 1, wherein the RF transmission line is a transverse-electromagnetic mode (TEM) line.

5. The RF transmission line of claim 1, further comprising a connector structure at a first distal end of the RF transmission line, wherein:

the connector structure comprises a ground reference structure that is conductively coupled to the first conductive layer;

the second conductive layer is conductively coupled to the center conductor; and the connector structure is a coaxial connector that comprises a center pin that is conductively coupled to the center conductor and the RF choke element at a node.

6. The RF transmission line of claim 5, wherein:

the first conductive layer lies in a first plane;

the second conductive layer lies in a second plane that is parallel to the first plane; and the center conductor lies at least partially in a third plane that is parallel to, and positioned vertically between, the first plane and the second plane.

7. The RF transmission line of claim 6, wherein:

the node lies in the second plane; and the center conductor is conductively coupled to the node by a via that passes at least partially through the dielectric material.

8. The RF transmission line of claim 1, wherein:

the RF choke element comprises an inductor;

the inductor is disposed at least partially above a top surface of the RF transmission line; and the second conductive layer has an opening therein at least partially below the inductor.

9. The RF transmission line of claim 8, wherein the center conductor is routed around the opening such that the opening does not vertically overlap the center conductor.

10. The RF transmission line of claim 1, further comprising a blocking capacitor coupled between the center conductor and one end of the RF choke element.

11. The RF transmission line of claim 1, wherein a cross-section of the RF transmission line at a midpoint along a longitudinal dimension of the RF transmission line has a thickness in a vertical dimension of the RF transmission line that is less than 3 mm.

12. The RF transmission line of claim 1, wherein the first conductive layer is separated from the second conductive layer by a constant distance along a length of the center conductor.

13. The RF transmission line of claim 1, further comprising an RF shielding structure that at least partially covers the RF choke element.

14. The RF transmission line of claim 13, wherein the RF shielding structure comprises a conductive lip configured to capacitively couple to one of the first conductive layer and the second conductive layer.

15. The RF transmission line of claim 14, wherein the RF shielding structure further comprises a second conductive lip configured to capacitively couple to another of the first conductive layer and the second conductive layer.

16. The RF transmission line of claim 1, wherein the second conductive layer has a first resistance, and the center conductor has a second resistance greater than the first resistance.

17. The RF transmission line of claim 1, wherein the second conductive layer has a first current capacity, and the center conductor has a second current capacity that is less than the first current capacity.

18. A data communication system comprising:

an indoor signal processing unit comprising a first coaxial cable including a first central conductor and a first ground structure, the indoor signal processing unit configured to communicate a multiplexed signal comprising an RF component and a direct current (DC) component via the first coaxial cable;

an outdoor signal processing unit comprising a second coaxial cable including a second central conductor and a second ground structure, the outdoor signal processing unit configured to communicate the multiplexed signal via the second coaxial cable; and a flat transmission line connected at a first end to the first coaxial cable and at a second end to the second coaxial cable, the flat transmission line comprising:

a first conductive layer conductively coupled to the first ground structure and the second ground structure;

a second conductive layer physically isolated from the first conductive layer;

a center conductor disposed between the first conductive layer and the second conductive layer, the center conductor being coupled to the first central conductor and the second central conductor to carry the RF component;

a first radio frequency (RF) choke element conductively coupled to a first end of the center conductor and to a first end of the second conductive layer; and a second RF choke element conductively coupled to a second end of the center conductor and to a second end of the second conductive layer, wherein the first and second RF choke elements are configured to conduct at least a portion of the DC component of the multiplexed signal between the center conductor and the second conductive layer.

19. The data communication system of claim 18, wherein the flat transmission line is configured to be installed between a window pane and a frame of a window installment.

20. The data communication system of claim 18, wherein the outdoor signal processing unit is coupled to an antenna configured to wirelessly communicate the RF component of the multiplexed signal.

21. The data communication system of claim 18, wherein the center conductor is coupled to the first central conductor and the second central conductor to carry a portion of the DC component.

22. A method of manufacturing a radio frequency (RF) cable, the method comprising:

disposing first and second conductive layers on a substrate, the substrate conductively isolating the first conductive layer from the second conductive layer;

forming a center conductor between the first conductive layer and the second conductive layer in the substrate; and conductively coupling an RF choke element between the center conductor and the second conductive layer, the RF choke element being configured to conduct a direct current signal between the center conductor and the second conductive layer.

23. The method of claim 22, wherein the RF choke element comprises an inductor connected in series with the second conductive layer.

24. The method of claim 22, further comprising conductively coupling a signal transmission pin of a coaxial cable connector to the center conductor and the RF choke element at a node.

25. The method of claim 24, further comprising forming a conductive via connecting the center conductor to the node.

26. The method of claim 22, wherein the RF choke element comprises an inductor, the method further comprising:

forming a first window in the first conductive layer at least partially below the inductor; and forming a second window in the second conductive layer at least partially below the inductor.

27. The method of claim 26, wherein said disposing the center conductor comprises routing the center conductor such that the first window and the second window do not vertically overlap the center conductor.

28. The method of claim 22, further comprising covering the RF choke element with an RF shielding structure.

29. The method of claim 28, further comprising disposing a lip of the RF shielding structure above the second conductive layer to capacitively couple the lip form to the second conductive layer.

30. A method of communicating data, the method comprising:

providing a signal having a direct current (DC) component and a radio-frequency (RF) component to a node of a flat RF cable, the node being conductively coupled to a first conductive layer of the flat RF cable and a center conductor of the flat RF cable;

blocking the RF component from propagating on the first conductive layer using an inductor connected in series with the first conductive layer;

communicating a first portion of the DC component through the inductor and on the first conductive layer;

communicating a second portion of the DC component on the center conductor; and communicating the RF component on the center conductor, wherein a second conductive layer of the flat RF cable provides an RF ground, and the first conductive layer provides a virtual RF ground, for said communicating the RF component on the center conductor.

31. The method of claim 30, wherein the second conductive layer is configured to capacitively couple to the first conductive layer to provide the virtual RF ground.

32. The method of claim 30, further comprising coupling a connector of the flat RF cable to a coaxial cable.

33. The method of claim 32, wherein said providing the signal to the node comprises communicating the signal on a central pin of the coaxial cable, the central pin being conductively coupled to the node.

* * * * *